US011781460B2

(12) United States Patent
Häberle et al.

(10) Patent No.: US 11,781,460 B2
(45) Date of Patent: Oct. 10, 2023

(54) SUPPORT ASSEMBLY

(71) Applicant: Purem GmbH, Neunkirchen (DE)

(72) Inventors: Jürgen Häberle, Stuttgart (DE); Christoph Buckermann, Kirchheim unter Teck (DE); Johannes Grupp, Donzdorf (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 17/674,560

(22) Filed: Feb. 17, 2022

(65) Prior Publication Data

US 2022/0260000 A1 Aug. 18, 2022

(30) Foreign Application Priority Data

Feb. 18, 2021 (DE) ..... 10 2021 103 851.0
Mar. 2, 2021 (DE) ..... 10 2021 104 934.2

(51) Int. Cl.
*F01N 13/18* (2010.01)
*F01N 3/28* (2006.01)

(52) U.S. Cl.
CPC ..... *F01N 3/2867* (2013.01); *F01N 3/2853* (2013.01); *F01N 2450/02* (2013.01)

(58) Field of Classification Search
CPC .... F01N 3/2839; F01N 3/2853; F01N 3/2867; F01N 2350/06; F01N 2450/02
See application file for complete search history.

(56) References Cited

U.S. PATENT DOCUMENTS 4,279,864 A * 7/1981 Nara ..... F01N 3/2853 422/179
4,353,873 A * 10/1982 Noritake ..... F01N 3/2853 422/177
4,396,664 A * 8/1983 Mochida ..... F01N 3/2853 428/116

(Continued)

FOREIGN PATENT DOCUMENTS

DE 103 00 780 A1 7/2004
DE 10 2008 016 236 A1 10/2009

(Continued)

OTHER PUBLICATIONS

Machine translation of JP 2013-160149 A, accessed Feb. 24, 2023. (Year: 2023).*

*Primary Examiner* — Jonathan R Matthias
(74) *Attorney, Agent, or Firm* — Walter Ottesen, P.A.

(57) ABSTRACT

A support assembly supports an exhaust gas treatment element of an exhaust gas treatment unit for an exhaust gas system of an internal combustion engine. A carrying body is secured on a housing of an exhaust gas treatment unit and surrounds an assembly center axis as a ring or annulus. At least one flexible supporting element is carried on the carrying body. The supporting element has an exhaust gas treatment element supporting side for supporting interaction with an exhaust gas treatment element. The carrying body has a radial limb at least partially engaging radially over the supporting element on a carrying body supporting side facing away from the exhaust gas treatment element supporting side. The supporting element is supported by the carrying body supporting side thereof on the radial limb so as to be shiftable radially inward with respect to the carrying body.

14 Claims, 4 Drawing Sheets

(56) References Cited

U.S. PATENT DOCUMENTS

| | | | | |
|---|---|---|---|---|
| 6,685,888 | B1 * | 2/2004 | Shibata | F01N 3/2867 422/177 |
| 2004/0139741 | A1 | 7/2004 | Balle et al. | |
| 2009/0241512 | A1 | 10/2009 | Wirth | |
| 2015/0240684 | A1 | 8/2015 | Kast | |
| 2016/0208673 | A1 | 7/2016 | Ferencak | |

FOREIGN PATENT DOCUMENTS

| | | | | |
|---|---|---|---|---|
| DE | 10 2014 203 495 | A1 | 8/2015 | |
| DE | 10 2015 100 552 | B3 | 6/2016 | |
| JP | 2013160149 | A | 8/2013 | |
| WO | WO-2011066041 | A1 * | 6/2011 | B01D 46/0005 |

* cited by examiner

SUPPORT ASSEMBLY

CROSS REFERENCE TO RELATED APPLICATIONS

This application claims priority of German patent application nos. 10 2021 103 851.0, filed Feb. 18, 2021, and 10 2021 104 934.2, filed Mar. 2, 2021, the entire contents of which are incorporated herein by reference.

TECHNICAL FIELD

The present disclosure relates to a support assembly with which, in the case of an exhaust gas treatment unit for an exhaust gas system of an internal combustion engine, an exhaust gas treatment element, which is inserted into a housing of the exhaust gas treatment unit, can be supported at a defined axial positioning with respect to the housing and can therefore be held against an axial movement. The disclosure furthermore relates to a method for producing an exhaust gas treatment unit using such a support assembly.

BACKGROUND

A support assembly of this type, after one or more exhaust gas treatment elements have been arranged in a housing which is elongate in the direction of a housing longitudinal axis, is inserted into the housing in a manner adjoining such an exhaust gas treatment element and is generally secured to the housing by welding such that such an exhaust gas treatment element is held, on at least one axial side, against an axial movement with respect to the housing.

SUMMARY

It is an object of the present disclosure to provide a support assembly for an exhaust gas treatment element of an exhaust gas treatment unit for an internal combustion engine and a method for producing an exhaust gas treatment unit, wherein the risk of damage to an exhaust gas treatment element to be supported can be eliminated with a reliable support effect.

According to a first aspect of the present disclosure, the aforementioned object, can, for example, be achieved by a support assembly for supporting an exhaust gas treatment element, which is accommodated in a housing, of an exhaust gas treatment unit for an exhaust gas system of an internal combustion engine. The support assembly according to the disclosure includes a carrying body which is to be secured on a housing of an exhaust gas treatment unit and surrounds an assembly center axis in the manner of a ring, and at least one flexible supporting element, which is carried on the carrying body, wherein the supporting element has an exhaust gas treatment element supporting side for supporting interaction with an exhaust gas treatment element, wherein the carrying body has a radial limb at least partially engaging radially over the supporting element on a carrying body supporting side facing away from the exhaust gas treatment element supporting side, wherein the supporting element is supported by its carrying body supporting side on the radial limb so as to be shiftable radially inward with respect to the carrying body.

In the support assembly according to the disclosure, the configuration of the ring-like carrying body makes it possible for there to be a relative movement between the carrying body and the supporting element which is carried or supported thereon. It is thereby possible to avoid radial relative movements, which arise for example due to different thermal loadings, between the supporting element and the exhaust gas treatment element axially supported by the latter, which radial relative movements, in particular when such an exhaust gas treatment element is configured with ceramic material, may lead to damage to the exhaust gas treatment element, for example due to material regions breaking off on the outer circumference. Such relative movements in the radial direction can occur between the supporting element and the carrying body since the supporting element is basically not blocked by the carrying body against movement radially inward.

In order to be able to provide a uniform supporting effect over the circumference, the supporting element can be configured in the manner of a ring.

The supporting element and the carrying body can be held together, for example, by the supporting element being held on the carrying body by a radial interference fit or/and material bonding. The radial interference fit causes the supporting element to be held by frictional bonding on the outer limb against dropping out of the carrying body. If, alternatively or additionally, a material bonding is intended to be provided, the latter is selected in such a manner that a radial relative movement between the carrying body and the supporting element is substantially not obstructed. For example, such a material bonding can be restricted to a few connecting points, for example two or three connecting points lying at a circumferential distance from one another, between the carrying body and the supporting element, at which connecting points the material bonding is provided by adhesive bonding or welding or soldering.

For a thermally stable configuration which is resistant to exhaust gas, it is proposed that the supporting element is constructed with wire material, preferably in the form of braided wire, woven wire or weft-knitted wire.

If the radial limb radially substantially completely engages over the supporting element on its carrying body supporting side, stable support of the supporting element itself is ensured. If it is furthermore provided that the radial limb does not protrude substantially radially inward over the supporting element, a maximum flow cross section opened up for exhaust gas to pass through can be achieved. In a configuration which is structurally simple to realize, it is possible to avoid blocking the supporting element against a movement radially inward by the carrying body by the radial limb not engaging axially over the supporting element on its radial inner side. That is, no portions obstructing the movement of the supporting element radially inward protrude from the radial limb in the axial direction, that is, in a manner engaging axially over the supporting element.

In order to provide a stable structure, the carrying body can have an outer limb, wherein the radial limb is angled with respect to the outer limb and extends radially inward from the outer limb. With such a structure, in which the carrying body has only two limbs, that is, the outer limb and the radial limb, portions on the carrying body that might obstruct a movement of the supporting element radially inward with respect to the radial limb can be avoided in a simple manner.

The carrying body can have an L-shaped or V-shaped longitudinal sectional profile with the radial limb and the outer limb.

In order to provide sufficient axial deformability of the supporting element while the supporting element is stably accommodated in the carrying body, the outer limb can engage, preferably not completely, radially outward axially over the supporting element.

In an alternative configuration, the outer limb can extend away from the radial limb in a direction axially away from the supporting element, such that radially on the outside no portions of the carrying body engage in the intermediate space formed between a supported exhaust gas treatment element and a housing accommodating the latter. The carrying body can be formed in a manner adapted to the shaping of a housing of an exhaust gas treatment unit such that the outer limb extends substantially axially or extends axially away and radially inward from the radial limb.

Depending on the required deformability of the supporting element, the outer limb can lie on a radial outer side of the supporting element or can be at a radial distance from the radial outer side of the supporting element.

The disclosure furthermore relates to an exhaust gas treatment unit for an exhaust gas system of an internal combustion engine, including a housing which is elongate in the direction of a housing longitudinal axis and at least one exhaust gas treatment element which is supported axially in the housing in the direction of the housing longitudinal axis by at least one support assembly according to the disclosure and through which exhaust gas can flow.

According to a further aspect, an object mentioned at the beginning is achieved by a method for producing an exhaust gas treatment unit for an exhaust gas system of an internal combustion engine wherein an exhaust gas treatment unit produced by the method includes a housing which is elongate in the direction of a housing longitudinal axis and at least one exhaust gas treatment element which is axially supported in the housing in the direction of the housing longitudinal axis by at least one support assembly according to the disclosure and through which exhaust gas can flow. This method includes the measures of:

a) providing the housing which is elongate in the direction of a housing longitudinal axis and at least one exhaust gas treatment element which is to be accommodated in the housing, b) pushing the at least one exhaust gas treatment element into the housing in the direction of the housing longitudinal axis and positioning the at least one exhaust gas treatment element in the housing in such a manner that the at least one exhaust gas treatment element is held substantially at an axial installation position in the housing, c) positioning a support assembly constructed according to the disclosure in the housing on at least one axial end side of the at least one exhaust gas treatment element in such a manner that the supporting element of the support assembly comes with its exhaust gas treatment element supporting side into contact with a radially outer edge region of the axial end side.

In order to facilitate the introduction of the at least one exhaust gas treatment element or also of a support assembly according to the disclosure, in measure a), the housing in at least one axial end region can be provided widening radially toward an axial end of the housing. Such a radially widening axial end region thus provides an introducing slope.

For stable and uniform holding of the at least one exhaust gas treatment unit in the housing, it is furthermore proposed that, in measure a), the housing is provided in a substantially cylindrical length portion accommodating the at least one exhaust gas treatment unit in its installation position.

In measure a), the housing can be provided with a first housing part for receiving the at least one exhaust gas treatment element and with at least one second housing part for receiving a support assembly.

In a procedure minimizing a mechanical loading of the at least one exhaust gas treatment element, in measure b), the at least one exhaust gas treatment element can be surrounded by a flexible holding structure, preferably a fiber mat, and can be pushed with the flexible holding structure surrounding it into the housing in such a manner that the at least one exhaust gas treatment element is held substantially in its installation position in the housing by radial compression of the flexible holding structure.

For a defined supporting effect in the axial direction, in measure c), the support assembly can be inserted into the housing in such a manner that its supporting element lies under axial compression on the end side of the at least one exhaust gas treatment element.

In order, as soon as a support assembly is inserted into the housing, to be able to lock the support assembly stably and in a fixedly predetermined position with respect to the housing, it is proposed that, in measure c), the support assembly is inserted into the housing in such a manner that its carrying element is held by a radial interference fit in the housing.

A uniform loading during the interaction of a support assembly with an exhaust gas treatment element can be achieved in that, in measure c), the support assembly is inserted into the housing in such a manner that its supporting element protrudes radially outward with respect to the end side of the at least one exhaust gas treatment element.

If the housing is provided with the first and at least one second housing part, in measure b), the at least one exhaust gas treatment element can be inserted into the first housing part, and, in measure c), a support assembly can be inserted into at least one second housing part or positioned lying on the axial end side and, subsequently, the second housing part can be positioned on the first housing part in such a manner that the support assembly comes into or/and is held in contact with the radially outer edge region of the axial end side.

In the method, a measure d) can furthermore be provided for securing the carrying body on the housing. If, in measure c), the at least one support assembly is inserted into the housing or housing part in which the at least one exhaust gas treatment element is also accommodated, measure d) is carried out after measure c). If, in measure c), the at least one support assembly is inserted into a second housing part while the at least one exhaust gas treatment element has been inserted into the first housing part in measure b), measure d) is carried out during measure c) after a support assembly has been inserted into a second housing part accommodating the latter and before this assembly of second housing part and support assembly is positioned on the first housing part, which already contains the at least one exhaust gas treatment element, and is preferably connected fixedly to the housing part.

In measure d), the carrying body can be secured on the housing by material bonding, for example welding.

For simple implementation of the method and in order to avoid excessive thermal and thus also mechanical loading of an exhaust gas treatment element when the carrying body is secured on the housing, in measure d), the carrying body can be secured on the housing by a plurality of material bonding regions formed at a distance from one another in the circumferential direction.

BRIEF DESCRIPTION OF THE DRAWINGS

The invention will now be described with reference to the drawings wherein.

DESCRIPTION OF THE PREFERRED EMBODIMENTS

Figure 1:
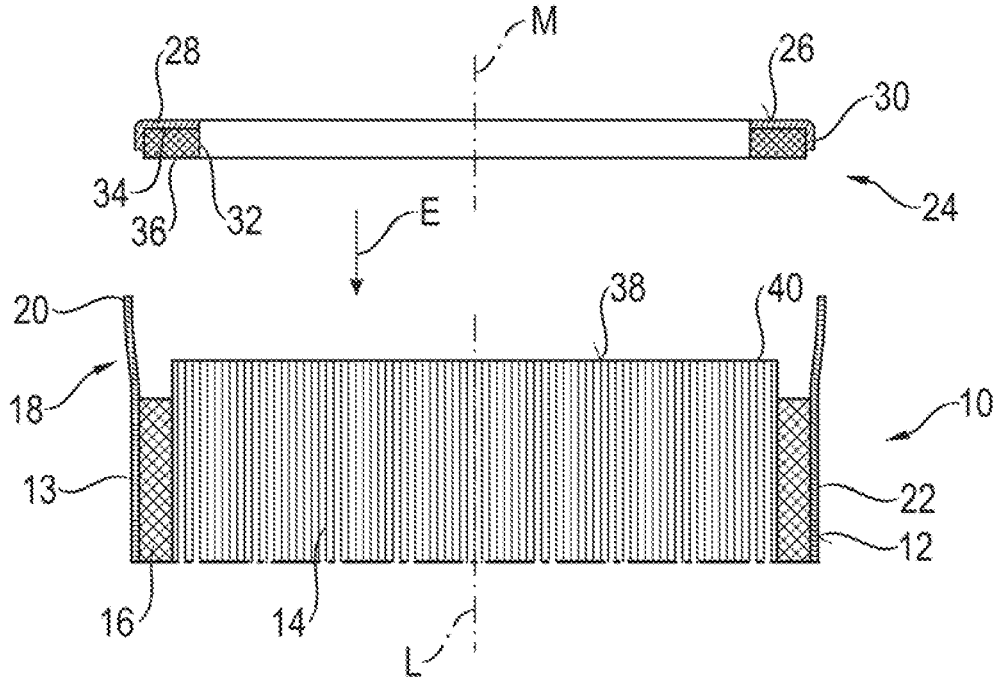
FIG. 1 shows a phase of a production method, in which a support assembly is moved toward an exhaust gas treatment element held in a housing of an exhaust gas treatment unit.

FIG. 1 shows a phase of a method for producing an exhaust gas treatment unit 10 for an exhaust gas system of an internal combustion engine. An exhaust gas treatment unit of this type includes a housing 12 with a housing part 13 which is, for example, tubular and is elongate in the direction of a housing longitudinal axis L and in which an exhaust gas treatment element 14 is held by a flexible holding structure 16 surrounding it. The exhaust gas treatment element 14 can include, for example, a monolith which is constructed with ceramic material, is provided with a porous structure and therefore exhaust gas can flow therethrough. On its surface providing the porous structure, the exhaust gas treatment element 14 can be constructed or/and coated with catalytically active material in order to carry out a catalytic reaction, for example a selective catalytic reduction, in the exhaust gas treatment unit 10. The flexible holding structure 16 can include, for example, a fiber mat which is wound around the outer circumference of the exhaust gas treatment element 14 and is held under radial compression between the exhaust gas treatment element 14 and the housing 12 or its housing part 13 and therefore holds the exhaust gas treatment element 14 in a defined position in the housing 12.

During the production of an exhaust gas treatment unit 10 of this type, first of all the housing 12 is provided with its tubular housing part 13. In this case, as can be seen in FIG. 1, the housing 12 or its tubular housing part 13 can be configured widening radially at least at one of its axial end regions 18 toward the axial end 20, such that an introducing slope is formed for the exhaust gas treatment element 14, which is surrounded by the flexible holding structure 16, for the axial pushing into the housing part 13 in a pushing-in direction E.

The exhaust gas treatment element 14 is pushed with the flexible holding structure 16 surrounding it into the housing part 13 to such an extent that it is held in the housing 12 or in the housing part 13 in an installation position provided for the finished construction and substantially lies in a cylindrical length portion 22 of the housing part 13. The cross-sectional geometry of the cylindrical length portion 22 or of the entire housing part 13 corresponds to the cross-sectional geometry of the exhaust gas treatment unit 10 to be constructed therewith. If the exhaust gas treatment unit 10 is intended to have a circular outer circumferential contour, the housing 12 or the length portion 22 is in the form of a circular cylinder. If the exhaust gas treatment unit 10 is intended to have an elliptical, oval or generally flattened round cross-sectional geometry, the housing 12 or the length portion 22 is configured to be cylindrical with corresponding shaping.

A support assembly denoted in general by 24 is subsequently inserted into the end region 18 of the housing part 13 of the housing 12. The support assembly 24 includes a carrying body 26 surrounding an assembly center axis M in the manner of a ring. The carrying body 26 which preferably provides a closed ring has, in longitudinal section along the assembly center axis M, an L-shaped profile with a radial limb 28 extending, for example, substantially orthogonally with respect to the assembly center axis M, and an outer limb 30 which is preferably substantially parallel to the assembly center axis M and therefore provides a cylindrical structure and which adjoins the radial limb 28 in the outer end region thereof and provides an axial limb extending substantially in the axial direction. For example, the carrying body 26 can be provided as a sheet-metal formed part. In this configuration, the radial limb 28 and the outer limb 30 are arranged, for example, virtually orthogonally with respect to each other.

The shaping of the ring-like carrying body 26 is adapted to the cross-sectional geometry of the housing 12. If the housing part 13 of the housing 12 has a circular cross-sectional geometry, the carrying body 26 or the entire support assembly 24 is correspondingly in the shape of a circular ring. If the housing 12 or the housing part 13 has an elliptical, oval or generally flattened round cross-sectional geometry, the carrying body 26 or the entire support assembly 24 has a corresponding shaping.

The support assembly 24 furthermore includes a flexible, that is, compressible, supporting element 32 which, for example, is likewise ring-like and is preferably likewise configured as a closed ring. The supporting element 32 can be constructed with wire material, that is, for example, with a braided wire, a woven wire or a weft-knitted wire, and is inserted into the carrying body 26 in such a manner that the radial limb 28 substantially completely radially covers the supporting element 32 on a carrying body supporting side 34, and the outer limb 30 engages partially axially radially on the outside over the supporting element 32 and lies on a radial outer side of the supporting element 32. However, the carrying body 26 does not have any portions which obstruct a movement of the supporting element 32 radially inward with respect to the carrying body 26. In particular, the carrying body 26 does not have any portions which completely or partially engage over the radial limb 28 axially or the supporting element 32 on its radial inner side and which, by interaction with the supporting element 32 on its radial inner side, block the supporting element 32 against a movement radially inward with respect to the carrying body 26.

In order to hold together the supporting element 32 and the carrying body 26, the supporting element 32 can be dimensioned in coordination with the carrying body 26 in such a manner that it is held by a radial interference fit by the outer limb 30 by frictional bonding. Alternatively or additionally, a material bonding between the supporting element 32 and the carrying body 26 can be achieved at one or more circumferential positions, for example by adhesive bonding, welding or soldering. Since this connection obtains a significance only before the support assembly 24 is integrated in the housing 12, it does not have to be able to absorb any particular loading. It is sufficient if an inadvertent dropping of the supporting element 32 out of the carrying body 26 is prevented. For this purpose, alternatively or additionally to the frictional bonding achieved by the radial interference fit, the material bonding generated at one or a few circumferential regions may be sufficient.

Figure 2:
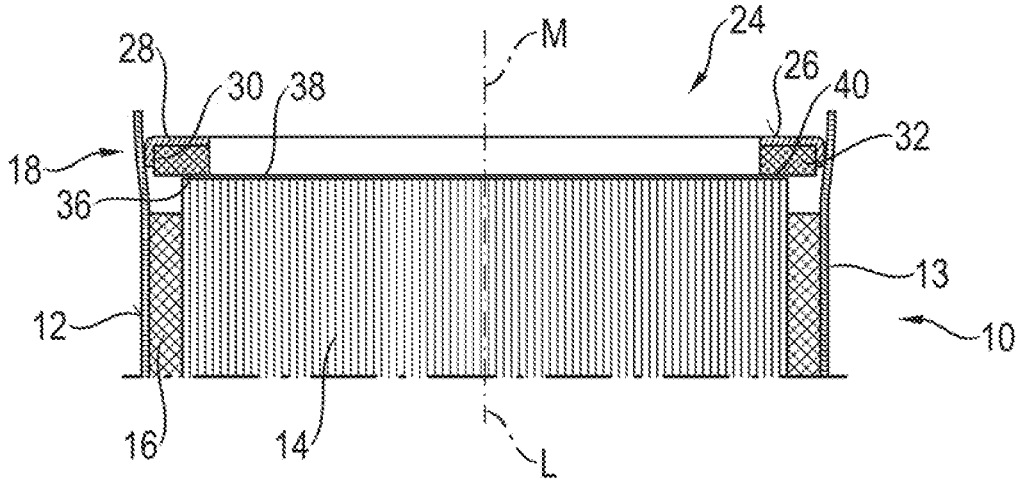
FIG. 2 shows a phase of the production method, in which the support assembly lying axially on the exhaust gas treatment element is inserted into the housing.

After the exhaust gas treatment element 14 has been arranged substantially in its installation position in the housing 12 in the previously described way, the support assembly 24 is subsequently inserted in the pushing-in direction E into the axial end region 18 of the housing part 13. The radially widening axial end region 18 can also here provide the function of an introducing slope along which the carrying body 26 is pushed by its outer limb 30 until the positioning of the support assembly 24 illustrated in FIG. 2 is reached. In this positioning, the supporting element 32 lies with an exhaust gas treatment element supporting side 36 on an end side 38 of the exhaust gas treatment element 14, for example under axial compression of the supporting element 32 at least in the region in which the exhaust gas treatment element radially covers the supporting element 32 on its end side 38 in a radially outer edge region 40. In this state, the carrying body 26 can be held against dropping out of the housing 12 by a radial interference fit at the axial end region 18 of the housing 12. A uniform supporting effect for the exhaust gas treatment element 14 can be ensured by the fact that the outer circumferential dimensioning of the supporting element 32 is larger than the outer circumferential dimensioning of the exhaust gas treatment element 14, such that the supporting element 32 protrudes radially outward over the end side 38 of the exhaust gas treatment element 14, and therefore the entire outer edge region 40 is loaded substantially uniformly by the supporting element 32.

Figure 3:
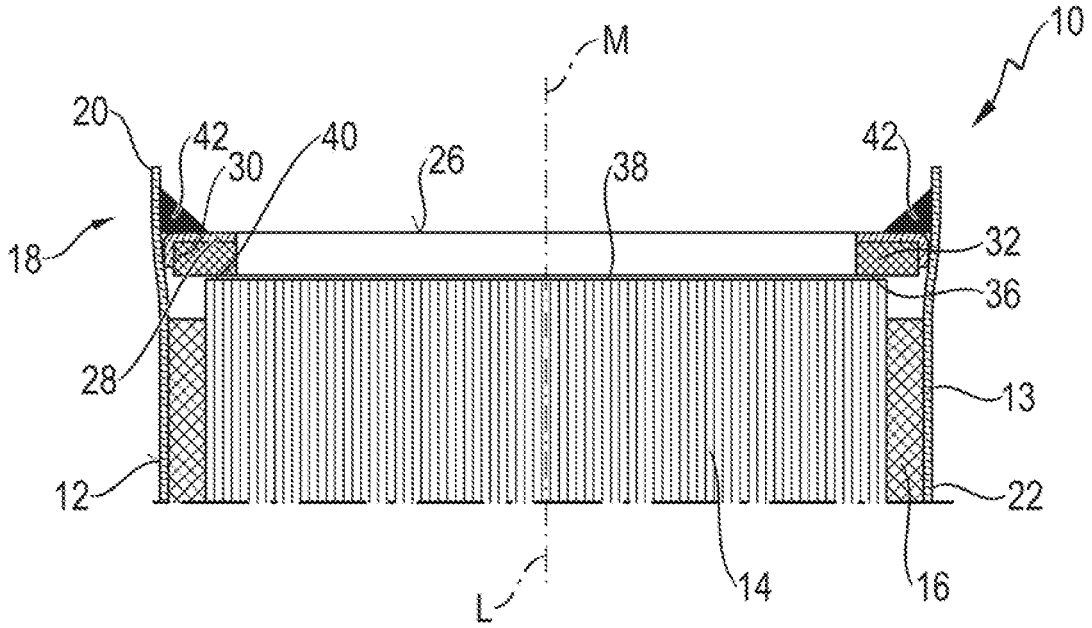
FIG. 3 shows a phase of the production method, in which the support assembly is secured on the housing by welding.

Subsequently, in a phase of the production method that is illustrated in FIG. 3, the support assembly 24 is secured on the housing 12 by material bonding, preferably by welding. In order to keep the input of heat as low as possible here, a plurality of discrete material bonding regions 42 can be produced in a manner distributed over the circumference, in which the carrying body 26 is attached in the region of the radial limb 28 or/and of the outer limb 30 to the inner surface of the housing 12 in the axial end region 18 in a material-bonding manner. For example, six material bonding regions 42 arranged at a uniform circumferential distance from one another can be produced.

With the construction, illustrated in FIG. 3, of an exhaust gas treatment unit 10 or the method described previously for producing same, an excessive mechanical loading of the exhaust gas treatment element 14, in particular in its radially outer edge region 40, is avoided with the use of the support assembly 24. Since the supporting element 32 is basically not blocked against a movement radially inward with respect to the carrying body 26, it is possible, in the event that a radial relative movement is required, in particular because of different thermal expansions during the production operation or else during operation of an exhaust gas system, for such a relative movement to occur between the carrying body 26 and the supporting element 32 while a relative movement between the exhaust gas treatment element 14 and the supporting element 32, the relative movement leading to too great a loading of the exhaust gas treatment element 14 in the radially outer edge region 40, is avoided.

The occurrence of a radial relative movement between the carrying body 26 and the supporting element 32 while such a relative movement substantially does not arise between the supporting element 32 and the exhaust gas treatment element 14 is primarily caused by the fact that a coefficient of friction between the friction pairing of carrying body and supporting element is significantly smaller than a coefficient of friction between the friction pairing of supporting element and exhaust gas treatment element, and that there are no portions on the carrying body 26 blocking the supporting element 32 against a movement radially inward, in particular there are no portions which enter into blocking interaction with the radial inner side of the supporting element 32 and extend from the radial limb 28 in the direction of the exhaust gas treatment element 14. The risk of, for example, wherever a comparatively strong thermal loading occurs during the production of the material bonding regions 42 the exhaust gas treatment element 14 being damaged in its radially outer edge region 40, can therefore be eliminated. Furthermore, by means of the support assembly 24 engaging over the radially outer edge region 40, the intermediate space which is formed between the exhaust gas treatment element 14 and the housing 12 and which accommodates the flexible holding structure 16, which is configured, for example, as a fiber mat, is shielded against the exhaust gas flow such that, in particular by means of a support assembly 24 arranged at an upstream end region of the exhaust gas treatment element 14, erosion protection for the flexible holding structure 16 is also provided.

It should be noted that, in the case of the exhaust gas treatment unit 10 illustrated in the figures, such a support assembly 24 can be provided, for example, on both axial sides or end surfaces of the exhaust gas treatment element 14, in order to support the exhaust gas treatment element 14 in a defined manner in the axial direction and therefore to hold the same in the housing 12. A plurality of exhaust gas treatment elements 14 can also be arranged axially consecutively in the housing 12. The support assembly 24 can be arranged on at least one end side, preferably on both of the end sides which are then exposed axially, in order also to be able to hold such an assembly of exhaust gas treatment elements in the housing 12 in a defined manner.

In each case, the use of the support assembly 24 avoids an excessive shear loading of the outer edge region 40 in an embodiment of the support assembly 24 which is structurally simple to realize. In the construction of the support assembly with the carrying body 26 with an L-shaped longitudinal sectional profile, portions of the carrying body protruding radially inward over the radially inner edge region of the supporting element 32 are avoided such that the inner cross-sectional area, which is free for exhaust gas to flow through, of the support assembly 24, which is basically configured in the manner of a ring, can be provided to a maximum extent and therefore blocking of the exhaust gas treatment element 14 against throughflow of exhaust gas by the support assembly 24 can be avoided as far as possible.

Figure 4:
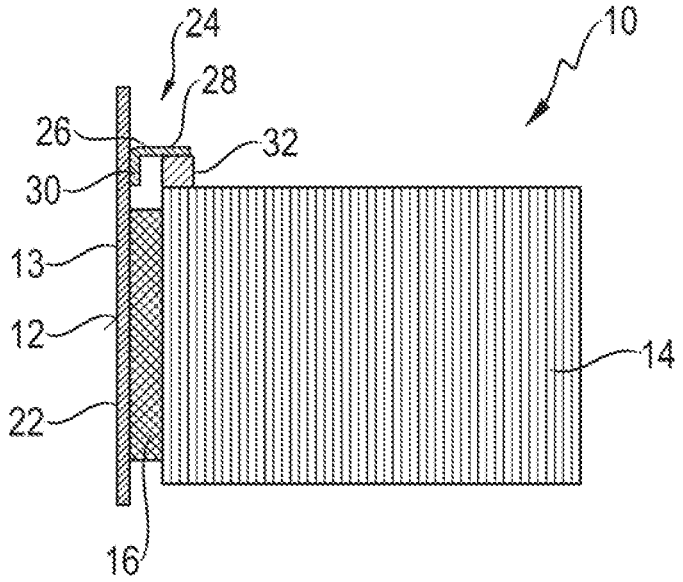
FIG. 4 shows a diagrammatic illustration of an alternative embodiment of a support assembly in an exhaust gas treatment unit.

An alternative embodiment of a support assembly 24 or of an exhaust gas treatment unit 10 having such a support assembly 24 is illustrated diagrammatically as a partial longitudinal section in FIG. 4. It is seen that, in this embodiment, the carrying body 26 is positioned with its outer limb 30 at a radial distance from a radial outer side of the supporting element 32. In particular, the supporting element 32 is dimensioned radially in such a manner that it does not protrude substantially radially outward over the exhaust gas treatment element 14.

In such a configuration, in which, although the outer limb 30 partially or completely engages axially over the supporting element 32 and therefore also provides an axial limb, the outer limb 30 also does not block the supporting element 32 against movement radially outward with respect to the carrying body 26, such that such a relative movement can also occur between the supporting element 32 and the carrying body 26, for example caused by different thermal expansions, without at the same time an axial relative movement also occurring between the supporting element 32 and the exhaust gas treatment element 14 which is supported axially thereon.

Figure 5:
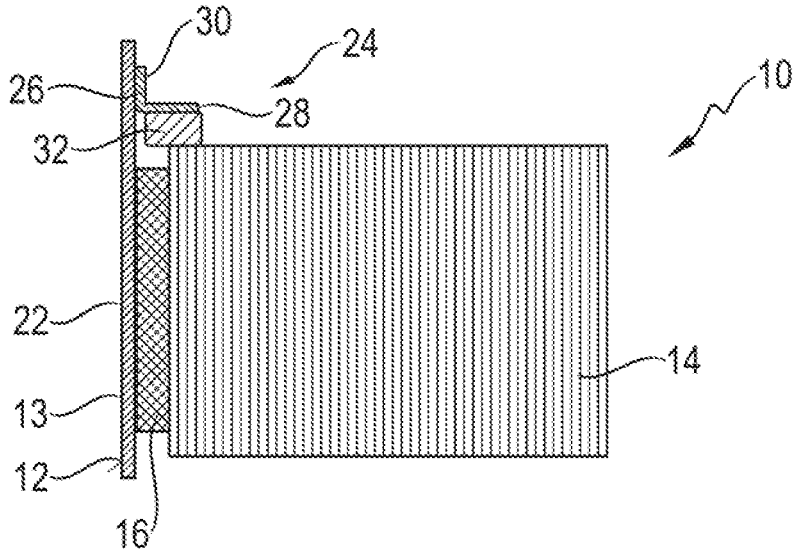
FIG. 5 shows an illustration corresponding to FIG. 4 of a further alternative embodiment.

In the embodiment illustrated in FIG. 5, the carrying body 26 again has the substantially L-shaped structure. However, the outer limb 30 extends axially from the radial limb 28 in a direction away from the exhaust gas treatment element 14 and therefore also away from the supporting element 32, such that the risk of the outer limb 30 coming into contact with the flexible holding structure 16 and possibly damaging the latter is eliminated.

Figure 6:
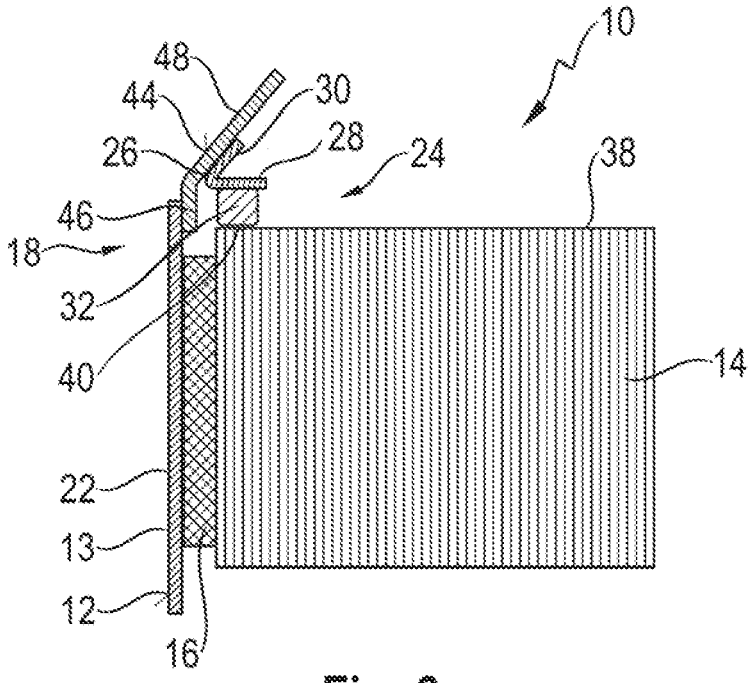
FIG. 6 shows an illustration corresponding to FIG. 4 of a further alternative embodiment; and, FIG. 7 shows an illustration corresponding to FIG. 4 of a further alternative embodiment.

A further alternative configuration is illustrated in FIG. 6. In this configuration, the housing 12 is constructed with the tubular housing part 13, which has already been discussed previously and which here forms a first housing part, and a second housing part 44 which adjoins the first housing part 13 at the axial end region 18. The second housing part 44 has a substantially cylindrical portion 46 which is inserted into the axial end region 18 of the first housing part 13 and can be connected fixedly and gas-tightly thereto, for example by welding. The portion 46 is adjoined by a portion 48 which, for example, tapers conically and in which the diameter of the housing 12 can be reduced, for example, to the diameter of an exhaust gas pipe adjoining the housing 12. In this configuration, the support assembly 24 is secured on the second housing part 44. This can take place, for example, by the support assembly 24 being inserted into the second housing part 44 and being secured by the outer limb 30 on the second housing part 44, for example in the region of the portion 48 thereof, for example by welding.

In the construction of such an exhaust gas treatment unit 10, first of all the exhaust gas treatment element 14 which is surrounded by the holding structure 16 can be inserted into the substantially cylindrical first housing part 13, such that it is held in the installation position provided for this purpose. The support assembly 24 is inserted in the previously described way into the second housing part 44 and secured thereon. The second housing part 44 together with the support assembly 24 already carried thereon is then positioned on the first housing part 13 such that the supporting element 32 lies on the end side 38 and therefore supports the exhaust gas treatment element 14 in a defined manner in the axial direction. A support assembly could also be provided in this way on the end side, at the bottom in FIG. 6, of the exhaust gas treatment element 14.

Since, in the configuration illustrated in FIG. 6, the outer limb 30 and the radial limb 28 are inclined with respect to each other at an angle different from 90°, with the carrying body 26 nevertheless providing an L or V-shaped longitudinal sectional structure, and since the outer limb 30 is positioned in respect of its angling with respect to the radial limb 28 in such a manner that it extends substantially parallel to the tapering portion 48 of the second housing part 44, the entire support assembly 24 is basically centered with respect to the first housing part 13 and therefore also with respect to the exhaust gas treatment element 14 arranged therein by means of the second housing part 44. It is therefore not absolutely necessary, during the assembly of the two housing parts 12, 13 with the exhaust gas treatment element 14 already positioned in the first housing part 13, to secure the support assembly 24 on the second housing part 44. On the contrary, the support assembly 24 could be inserted loosely into the second housing part 44 or could be placed onto the end side 38 of the exhaust gas treatment element 14. By positioning the second housing part 44 on the first housing part 13 in such a manner that the support assembly 24 is pressed axially against the end side 38 of the exhaust gas treatment element 14, a defined radial positioning of the support assembly 24 is also predetermined at the same time, and therefore the risk of the support assembly being displaced radially in the second housing part 44 is virtually eliminated.

Figure 7:
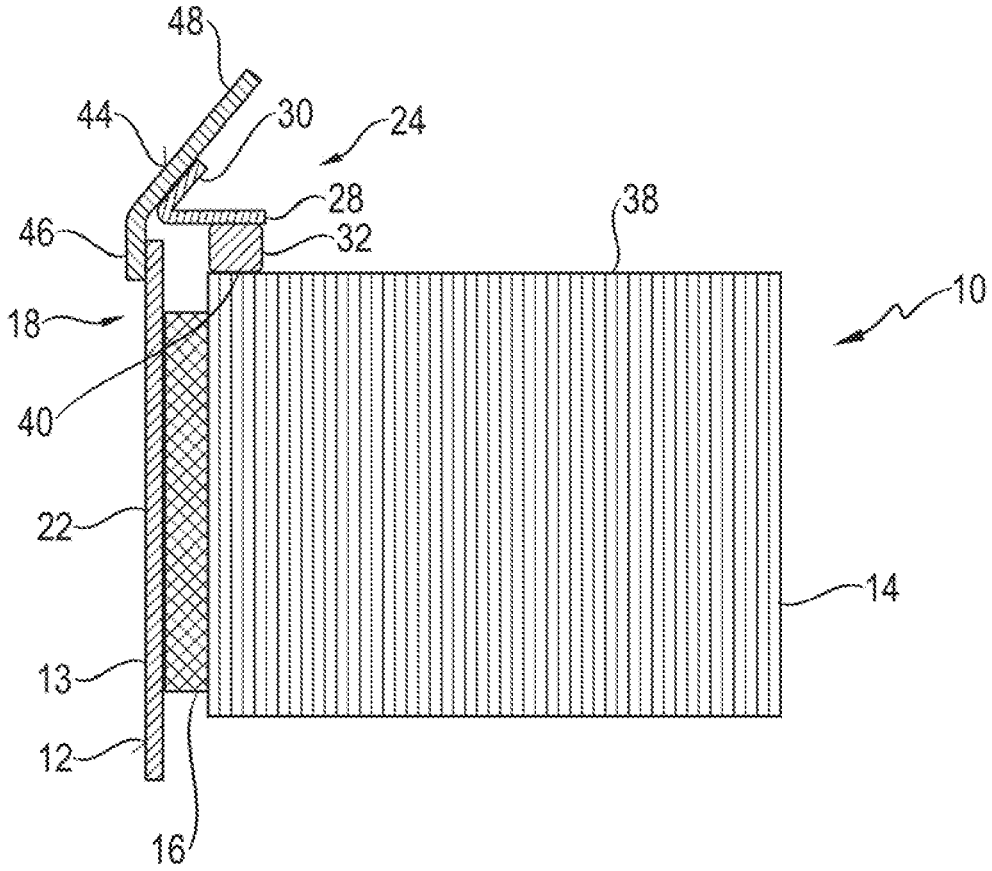

A modification of the embodiment illustrated in FIG. 6 is shown in FIG. 7. While, in the embodiment of FIG. 6, the substantially cylindrically shaped portion 46 of the second housing part 44 is inserted into the axial end region 18 of the first housing part 13, in the embodiment illustrated in FIG. 7 the second housing part 44 is shaped or dimensioned in such a manner that the substantially cylindrical portion 46 thereof engages radially on the outside around the first housing part 13 in its axial end region 18. This has the result that the radial limb 28 has a somewhat larger radial extent than in the embodiment of FIG. 6 in order nevertheless to be able to ensure that the outer limb 30 can lie on the tapering portion 48 of the second housing part 44 and can optionally be secured thereon.

It is understood that the foregoing description is that of the preferred embodiments of the invention and that various changes and modifications may be made thereto without departing from the spirit and scope of the invention as defined in the appended claims.

What is claimed is:

1. A support assembly for supporting an exhaust gas treatment element of an exhaust gas treatment unit for an exhaust gas system of an internal combustion engine, the exhaust gas treatment element being accommodated in a housing, and the support assembly defining an assembly center axis (M) and comprising:

a carrying body configured to be secured to said housing of said exhaust gas treatment unit;

said carrying body being further configured to surround said assembly center axis (M) as an annulus;

at least one flexible support element carried on said carrying body;

said support element being configured to be an annulus and having an exhaust gas treatment element supporting side for supporting interaction with said exhaust gas treatment element;

said support element having a carrying body supporting side facing away from said exhaust gas treatment element supporting side thereof;

said carrying body having a radial limb at least partially engaging radially over said support element on said carrying body supporting side facing away from said exhaust gas treatment element supporting side of said support element and not engaging axially over said support element on a radial inner side thereof;

said carrying body having an outer limb, said outer limb engaging radially outside axially over said support element and laying on a radial outer side of said support element, said radial limb being at an angle with respect to said outer limb and extending radially inward from said outer limb; and, said support element being held on said carrying body only by radial interference fit and being supported at said carrying body support side on said radial limb so as to be shiftable radially inward with respect to said carrying body.

2. The support assembly of claim 1, wherein said support element is configured of wire material.

3. The support assembly of claim 2, wherein said support element is configured of braided wire, woven wire or weft-knitted wire.

4. The support assembly of claim 1, wherein at least one of the following applies:

a) said radial limb engages radially completely over said support element on said carrying body supporting side thereof; and, b) said radial limb does not protrude radially over said support element.

5. The support assembly of claim 1, wherein at least one of the following applies:

a) said carrying body is L-shaped when with said radial limb and said outer limb viewed in longitudinal section;

b) said outer limb engages not completely, radially outside axially over said support element; and, c) said outer limb extends axially.

6. An exhaust gas treatment unit for an exhaust gas system of an internal combustion engine, the exhaust gas treatment unit comprising:

a housing defining a housing longitudinal axis (L) and being configured to be elongated along said longitudinal axis (L);

at least one support assembly;

at least one exhaust gas treatment element axially supported in said housing in the direction of said longitudinal axis (L) by said at least one support assembly; and, said support assembly defining an assembly center axis (M) and including:

a carrying body configured to be secured to said housing of said exhaust gas treatment unit;

said carrying body being further configured to surround said assembly center axis (M) as an annulus;

at least one flexible support element carried on said carrying body;

said support element being configured to be an annulus and having an exhaust gas treatment element supporting side for supporting interaction with said exhaust gas treatment element;

said support element having a carrying body supporting side facing away from said exhaust gas treatment element supporting side thereof;

said carrying body having a radial limb at least partially engaging radially over said support element on said carrying body supporting side facing away from said exhaust gas treatment element supporting side of said support element and not engaging axially over said support element on a radial inner side thereof;

said carrying body having an outer limb, said outer limb engaging radially outside axially over said support element and laying on a radial outer side of said support element, said radial limb being at an angle with respect to said outer limb and extending radially inward from said outer limb; and, said support element being held on said carrying body only by radial interference fit and being supported at said carrying body support side on said radial limb so as to be shiftable radially inward with respect to said carrying body.

7. A method for making an exhaust gas treatment unit for an exhaust gas system of an internal combustion engine, the exhaust gas treatment unit including:

a housing defining a housing longitudinal axis (L) and being configured to be elongated along said longitudinal axis (L);

at least one support assembly;

at least one exhaust gas treatment element axially supported in said housing in the direction of said longitudinal axis (L) by said at least one support assembly; and, said support assembly defining an assembly center axis (M) and including:

a carrying body configured to be secured to said housing of said exhaust gas treatment unit;

said carrying body being further configured to surround said assembly center axis (M) as an annulus;

at least one flexible support element carried on said carrying body;

said support element being configured to be an annulus and having an exhaust gas treatment element supporting side for supporting interaction with said exhaust gas treatment element;

said support element having a carrying body supporting side facing away from said exhaust gas treatment element supporting side thereof;

said carrying body having a radial limb at least partially engaging radially over said support element on said carrying body supporting side facing away from said exhaust gas treatment element supporting side of said support element and not engaging axially over said support element on a radial inner side thereof;

said carrying body having an outer limb, said outer limb engaging radially outside axially over said support element and laying on a radial outer side of said support element, said radial limb being at an angle with respect to said outer limb and extending radially inward from said outer limb; and, said support element being held on said carrying body only by radial interference fit and being supported at said carrying body support side on said radial limb so as to be shiftable radially inward with respect to said carrying body; the method comprising the steps of:

a) providing the housing and at least one exhaust gas treatment element which is to be accommodated in the housing;

b) pushing the at least one exhaust gas treatment element into the housing in the direction of the housing longitudinal axis (L) and positioning the at least one exhaust gas treatment element in the housing in such a manner that the at least one exhaust gas treatment element is held substantially at an axial installation position in the housing; and, c) positioning the support assembly in the housing on at least one axial end side of the at least one exhaust gas treatment element in such a manner that the support element of the support assembly comes with its exhaust gas treatment element supporting side into contact with a radially outer edge region of the axial end side.

8. The method of claim 7, wherein at least one of the following applies:

(i) in step a), the housing in at least one axial end region is provided widening radially toward an axial end of the housing; or, (ii) in step a), the housing is provided with a first housing part for accommodating the at least one exhaust gas treatment element and at least with a second housing part for receiving a support assembly; and, (iii) in step a), the housing is provided in a substantially cylindrical length portion accommodating the at least one exhaust gas treatment unit in its installation position.

9. The method of claim 8, wherein, in step b), the at least one exhaust gas treatment element is inserted into the first housing part, and, in step c), a support assembly is inserted into at least one second housing part or is positioned lying on the axial end side, and the second housing part is positioned on the first housing part in such a manner that the support assembly comes into or/and is held in contact with the radially outer edge region of the axial end side.

10. The method of claim 7, wherein, in step b), the at least one exhaust gas treatment element is surrounded by a flexible holding structure and is pushed with the flexible holding structure surrounding the same into the housing in such a manner that the at least one exhaust gas treatment element is held substantially in the installation position thereof in the housing by radial compression of the flexible holding structure.

11. The method of claim 10, wherein said flexible holding structure is a fiber mat.

12. The method of claim 7, wherein, in step c), at least one of the following applies:

(i) the support assembly is inserted into the housing in such a manner that the support element thereof lies under axial compression on the end side of the at least one exhaust gas treatment element; or, (ii) the support assembly is inserted into the housing in such a manner that the carrying element thereof is held by a radial interference fit in the housing; and, (iii) the support assembly is inserted into the housing in such a manner that the support element thereof protrudes radially outward with respect to the end side of the at least one exhaust gas treatment element.

13. The method of claim 7, further comprising step d) which provides for securing the carrying body on the housing.

14. The method of claim 13, wherein, in step d), the carrying body is secured on the housing by a plurality of material bonding regions formed at a distance from one another in the circumferential direction.

* * * * *